US009241377B2

(12) United States Patent
Zhang et al.

(10) Patent No.: US 9,241,377 B2
(45) Date of Patent: Jan. 19, 2016

(54) LED BACKLIGHT DRIVING CIRCUIT, LCD DEVICE, AND METHOD FOR DRIVING THE LED BACKLIGHT DRIVING CIRCUIT

(71) Applicant: SHENZHEN CHINA STAR OPTOELECTRONICS TECHNOLOGY CO., LTD, Shenzhen (CN)

(72) Inventors: Hua Zhang, Shenzhen (CN); Fei Li, Shenzhen (CN)

( * ) Notice: Subject to any disclaimer, the term of this patent is extended or adjusted under 35 U.S.C. 154(b) by 133 days.

(21) Appl. No.: 13/982,752

(22) PCT Filed: Jun. 28, 2013

(86) PCT No.: PCT/CN2013/078307

§ 371 (c)(1),
(2) Date: Jul. 31, 2013

(87) PCT Pub. No.: WO2014/187015

PCT Pub. Date: Nov. 27, 2014

(65) Prior Publication Data

US 2014/0340295 A1 Nov. 20, 2014

(30) Foreign Application Priority Data

May 20, 2013 (CN) ..... 2013 1 0186389

(51) Int. Cl.

| | |
|---|---|
| ***G09G 3/36*** | (2006.01) |
| ***H05B 33/08*** | (2006.01) |
| ***G09G 3/34*** | (2006.01) |

(52) U.S. Cl.

CPC ..... *H05B 33/0815* (2013.01); *G09G 3/3426* (2013.01); *H05B 33/0809* (2013.01); *G09G 2320/064* (2013.01); *G09G 2360/144* (2013.01)

(58) Field of Classification Search

CPC ..... H05B 33/0815; H05B 33/0809; G09G 3/3426; G09G 2360/144; G09G 2320/064

See application file for complete search history.

(56) References Cited

U.S. PATENT DOCUMENTS

2006/0083033 A1* 4/2006 Myung et al. ..... 363/59
2008/0122291 A1* 5/2008 Uchimoto ..... H02M 3/1584 307/31

(Continued)

FOREIGN PATENT DOCUMENTS

CN 1592063 A 3/2005
CN 101069339 A 11/2007

(Continued)

OTHER PUBLICATIONS

Fang Dingy!, the International Searching Authority written comments, Feb. 2014, CN.

*Primary Examiner* — Grant Sitta
*Assistant Examiner* — Mihir Rayan

(57) ABSTRACT

A light emitting diode (LED) backlight driving circuit includes a power supply, an LED light bar, and a constant current driving chip that adjusts brightness of the LED light bar. The constant current driving chip receives the PWM dimming signal. N boost units are connected in series between the power supply and the LED light bar, and the N boost units are connected in parallel with each other. Comparing units are correspondingly coupled to control ends of one or more of (N−1) boost units. When a duty ratio of the PWM dimming signal is less than a preset threshold, the comparing unit drives a corresponding boost unit to turn off. N is an integer greater than or equal to 2.

7 Claims, 2 Drawing Sheets

(56) References Cited

U.S. PATENT DOCUMENTS

| | | | | |
|---|---|---|---|---|
| 2010/0026263 | A1* | 2/2010 | Moussaoui | H02M 3/1582 323/283 |
| 2012/0056865 | A1* | 3/2012 | Shih et al. | 345/212 |
| 2012/0187858 | A1 | 7/2012 | Omi et al. | |
| 2012/0256561 | A1* | 10/2012 | Kwon | H05B 33/0815 315/307 |
| 2013/0002162 | A1* | 1/2013 | Gao | H05B 33/0824 315/210 |
| 2013/0002224 | A1 | 1/2013 | Lin | |

FOREIGN PATENT DOCUMENTS

| | | | |
|---|---|---|---|
| CN | 101183836 | A | 5/2008 |
| CN | 101483951 | A | 7/2009 |
| CN | 201859160 | U | 6/2011 |
| CN | 102290030 | A | 12/2011 |
| CN | 102622986 | A | 8/2012 |
| CN | 103093729 | A | 5/2013 |

* cited by examiner

LED BACKLIGHT DRIVING CIRCUIT, LCD DEVICE, AND METHOD FOR DRIVING THE LED BACKLIGHT DRIVING CIRCUIT

TECHNICAL FIELD

The present disclosure relates to the field of a liquid crystal display (LCD), and more particularly to a light emitting diode (LED) backlight driving circuit, an LCD device, and a method for driving the LED backlight driving circuit.

BACKGROUND

A liquid crystal (LC) television includes a liquid crystal display (LCD) panel and a backlight unit, and the backlight unit usually uses a light emitting diode (LED) as a backlight source, where a plurality of LED lamps are connected in series to form an LED light bar driven to display by a backlight driving circuit. An LCD television, having a large size display panel, correspondingly requires a high backlight brightness, and needs a plurality of LED light bars that are connected in parallel, thus output power of an entire backlight unit is great; however, the backlight driving circuit using a single boost circuit does not provide a enough power, and uses two boost circuits to drive the plurality of LED light bars, where the two boost circuits are connected in parallel. As shown in FIG. 1, an external power source V+ is received by a first boost circuit 21 and a second boost circuit 22, which together drive the LED light bars 30. The first boost circuit 21 drives the LED light bars 30 through a first constant current driving chip 11, the second boost circuit 22 drives the LED light bars 30 through a second constant current driving chip 12.

Transfer efficiency of the boost circuit is the greatest in a full load working status. As the output power reduces, the transfer efficiency of the boost circuit reduces. Thus, when the first boost circuit 21 and the second boost circuit 22 simultaneously work in a light load status, heat loss of an entire backlight driving circuit is great, and transfer efficiency of two boost circuits is smaller than the transfer efficiency of signal boost circuit which works in the full load working status.

SUMMARY

The aim of the present disclosure is to provide a light emitting diode (LED) backlight driving circuit, a liquid crystal display (LCD) device, and a method for driving the LED backlight driving circuit capable of increasing transfer efficiency of a plurality of boost circuits.

The aim of the present disclosure is achieved by the following method.

An LED backlight driving circuit comprises a power supply, an LED light bar, and a constant current driving chip that adjusts brightness of the LED light bar. The constant current driving chip receives a pulse-width modulation (PWM) dimming signal, N boost units are connected in series between the power supply and the LED light bar, and the N boost units are connected in parallel with each other, comparing units are correspondingly coupled to control ends of one or more of (N−1) boost units, namely at least one boost unit is coupled to the comparing unit, at most (N−1) boost units are correspondingly coupled to the (N−1) comparing units. When a duty ratio of the PWM dimming signal is less than a preset threshold, the comparing unit drives a corresponding boost unit to turn off, and N is an integer greater than or equal to 2.

Furthermore, the comparing unit comprises a comparator, where a non-inverting end of the comparator receives a reference voltage, a converting unit is coupled to an inverting end of the comparator, and the converting unit converts the PWM dimming signal to an equivalent voltage. A changing-over controllable switch is connected in series between the control end of the boost unit and a ground terminal of the LED backlight driving circuit. The reference voltage is less than or equal to the equivalent voltage of the PWM dimming signal corresponding to the preset threshold, when an equivalent voltage outputted by the converting unit is less than the reference voltage, the comparator drives the changing-over controllable switch to turn off. This is a specific circuit structure of the comparing unit, the converting unit converts the PWM dimming signal having the rectangular wave to a stable direct voltage signal, and different duty ratios correspond to different direct voltage signal. Thus, the equivalent voltage of the PWM dimming signal corresponding to the preset threshold is regarded as a comparison reference, which is compared with an output voltage signal of the converting unit, and a result of comparison can be used to determine whether the duty ratio of the PWM dimming signal exceeds the preset threshold or not. The present disclosure converts a comparison of the duty ratio to a simple comparison of the voltage, which reduces a difficult degree of technology, development time, and development costs.

Furthermore, the converting unit comprises a filter resistor and a filter capacitor. The inverting end of the comparator receives the PWM dimming signal through the filter resistor, and the filter capacitor is connected in series between the inverting end of the comparator and the ground terminal of the LED backlight driving circuit. The present disclosure uses a resistance-capacity (RC) filter to convert a fluctuating PWM dimming signal having a high frequency into a stable voltage signal, which reduces costs.

Furthermore, (N−1) comparing units are correspondingly coupled to control ends of N−1 of N boost units, when the duty ratio of the PWM dimming signal is less than or equal to (100/N) %, the comparison unit drives the corresponding boost unit to turn off. When the duty ratio of the PWM dimming signal is less than or equal to (100/N) %, only one boost unit turns on, and the remaining boost unit turns off. When only one boost unit is in the operation, the power loss is the least. Because the only one boost unit loads fully, the output power of the one boost unit is great, thereby further improving the transfer efficiency and reducing the energy loss.

Furthermore, each of the boost units comprises an inductor, a diode, a voltage-adjusting controllable switch that adjusts voltage, and a capacitor. The power supply is coupled to an end of the inductor, an opposite end of the inductor is coupled to an anode of the diode, and the opposite end of the inductor is coupled to a ground terminal of the LED backlight driving circuit through the voltage-adjusting controllable switch. A cathode of the diode is coupled to an anode of the LED light bar, and the cathode of the diode is coupled to the ground terminal through the capacitor, a control end of the voltage-adjusting controllable switch is coupled to the constant current driving chip. This is a specific circuit structure of the boost unit.

Furthermore, the constant current driving chip comprises a control unit that controls the boost unit to output the voltage, and an adjusting unit that adjusts brightness of the LED light bar, the LED light bar is coupled to the ground terminal of the LED backlight driving circuit through the adjusting unit, and a control end of the adjusting unit receives the PWM dimming signal. This is a specific circuit structure of the constant current driving chip.

Furthermore, the adjusting unit comprises a dimming controllable switch that adjusts dimming, an input end of the dimming controllable switch is coupled to a cathode of the LED light bar, an output end of the dimming controllable switch is coupled to a ground terminal of the LED backlight driving circuit through a divider resistor, and a control end of dimming controllable switch receives the PWM dimming signal. Each of the boost units corresponds to one constant current driving chip, and the LED light bars are divided into N groups of LED light bars, each of the boost units controls one group of LED light bars. This is a specific circuit structure of the adjusting unit. Each of the constant current driving chips corresponds to each of the boost units, and different boost units and the control circuits thereof are independent with each other. Loss of each of the boost units and the constant current driving chip thereof does not influence other boost units and the constant current driving chips thereof. A plurality of the boost units drive a plurality of LED light bars, and a typical constant current driving chip usually has no plurality of pins correspondingly connected with the LED light bars, thus the plurality of the constant current driving chip are used to control the LED light bars without need to redesign the typical constant driving chip, thereby reducing development costs and time.

Furthermore, a number of the boost unit is two, and the control end of one of the two boost units is coupled to the comparison unit. The comparing unit comprises a comparator, a non-inverting end of the comparator receives a reference voltage a converting unit is coupled to an inverting end of the comparator, and the converting unit converts the PWM dimming signal to an equivalent voltage. A changing-over controllable switch is connected in series between the control end of the boost unit and a ground terminal of the LED backlight driving circuit. The converting unit comprises a filter resistor and a filter capacitor, the inverting of the comparator receives the PWM dimming signal through the filter resistor, and the filter capacitor is connected in series between the inverting end of the comparator and the ground terminal of the LED backlight driving circuit. The reference voltage is less than or equal to the equivalent voltage of the PWM dimming signal corresponding to 50% duty ratio; when the equivalent voltage outputted by the converting unit is less than the reference voltage, the comparator drives the changing-over controllable switch to turn off.

Furthermore, each of the boost units comprises an inductor, a diode, a voltage-adjusting controllable switch that adjusts voltage, and a capacitor. The power supply is coupled to an end of the inductor, an opposite end of the inductor is coupled to an anode of the diode, and the opposite end of the inductor is coupled to the ground terminal of the LED backlight driving circuit through the voltage-adjusting controllable switch. A cathode of the diode is coupled to an anode of the LED light bar, and cathode of the diode is coupled to the ground terminal through the capacitor. The constant current driving chip comprises a control unit and an adjusting unit that adjusts brightness of the LED light bar, a control end of the voltage-adjusting controllable switch is coupled to the control unit. The adjusting unit comprises a dimming controllable switch that adjust dimming, an input end of the dimming controllable switch is coupled to a cathode of the LED light bar, an output end of the dimming controllable switch is coupled to the ground terminal of the LED backlight driving circuit through a divider resistor, and a control end of dimming controllable switch receives the PWM dimming signal. Each of the boost units corresponds to one constant current driving chip, and the LED light bars are divided into two groups of LED light bars, each of the boost units controls one group of LED light bars. This is an LED backlight driving circuit having two boost units.

A liquid crystal display (LCD) device comprises the LED backlight driving circuit of the present disclosure.

A method for driving the LED backlight driving circuit where the LED backlight driving circuit comprises the power supply, the LED light bar, and the constant current driving chip that adjusts brightness of the LED light bar. The constant current driving chip receives the PWM dimming signal, N boost units are connected in series between the power supply and the LED light bar, and the N boost units are connected in parallel with each other. The method comprises:

A: setting the preset threshold of a duty ratio of the PWM dimming signal;

B: detecting the duty ratio of the PWM dimming signal; when the duty ratio is less than the preset threshold, entering step C; when the duty ratio is greater than the preset threshold, entering step D;

C: controlling at least one boost unit to turn off, returning to the step A; and D: maintaining the boost unit in a normal operation, returning to the step A;

N is an integer greater than or equal to 2.

Furthermore, in the step A, preserving a maximum output power $W_0$ of each of the boost units. In the step B, a number of the preset thresholds is (N−1), and each of the preset thresholds is the duty ratio of the PWM dimming signal corresponding to integer times of the output power $W_0$. In the step C, determining total requirement power W of the LED light bar, if W is less than or equal to $(N-x)\ W_0$, turning off x boost units, greater than or the step A, and x is a positive integer less than N. In the present disclosure, a method where the boost unit turns off one by one may be use. Namely, when a maximum output power of the (N−1) boost units can satisfy brightness requirement of the LED light bar, one boost unit turns off. When a maximum output power of the (N−2) boost units satisfies brightness requirement of the LED light bar, two boost units turn off, and so on. According to the above-mentioned method, least boost units drive the LED light bar, which improves the transfer efficiency and reduces energy loss.

The present disclosure uses the comparing unit to monitor the PWM dimming signal to adjust an average value of current flowing through the LED light bar, which may allow users to adjust backlight brightness of the LED light bar according to different ambient brightness. The PWM dimming signal is a rectangular wave signal and the constant current driving chip receives the PWM dimming signal, which makes the current flowing through the LED light bar to have the rectangular wave signal having a same duty ratio with the PWM dimming signal, where the average value of the current of the LED light bar changes according to change of the duty ratio of the current, and a corresponding LED backlight brightness also changes. Thus, an output power of the LED backlight driving circuit and the duty ratio of the PWM dimming signal are directly proportional. Therefore, when the duty ratio of the PWM dimming signal is less than the preset threshold, at least one boost unit is driven to turn off. At that time, the remaining boost unit has to load more output power. As the output power increases, the transfer efficiency of the boost unit increases when the boost unit is in operation, which reduces power loss.

DETAILED DESCRIPTION

The present disclosure provides a liquid crystal display (LCD) device comprising an LCD panel and a backlight unit. The backlight unit comprises a light emitting diode (LED) backlight driving circuit. The LED backlight driving circuit comprises a power supply, an LED light bar, and a constant current driving chip that adjusts brightness of the LED light bar, where the constant current driving chip receives a pulse-width modulation (PWM) dimming signal. N boost units are connected in series between the power supply and the LED light bar, and the N boost units are connected in parallel with each other. Comparing units are correspondingly coupled to control ends of one or more of (N−1) boost units, namely at least one boost unit is coupled to the comparing unit, at most (N−1) boost units are correspondingly coupled to the (N−1) comparing units.

When a duty ratio of the PWM dimming signal is less than a preset threshold, the comparing unit drives a corresponding boost unit to turn off.

N is an integer greater than or equal to 2.

The present disclosure uses the comparing unit to monitor the PWM dimming signal to adjust an average value of current flowing through the LED light bar, which may allow users to adjust backlight brightness of the LED light bar according to different ambient brightness. The PWM dimming signal is a rectangular wave signal and the constant current driving chip receives the PWM dimming signal, which makes the current flowing through the LED light bar to have the rectangular wave signal having a same duty ratio as the PWM dimming signal, where the average value of the current of the LED light bar changes according to change of the duty ratio of the current, and a corresponding LED backlight brightness also changes. Thus, an output power of the LED backlight driving circuit and the duty ratio of the PWM dimming signal are directly proportional. Therefore, when the duty ratio of the PWM dimming signal is less than the preset threshold, at least one boost unit is driven to turn off. At that time, the remaining boost unit has to load more output power. As the output power increases, the transfer efficiency of the boost unit increases when the boost unit is in operation, which reduces power loss.

Taking an example for the LED backlight driving circuit having two boost units, the present disclosure is further described in detail in accordance with the figures and the exemplary examples.

Example 1

Figure 1:
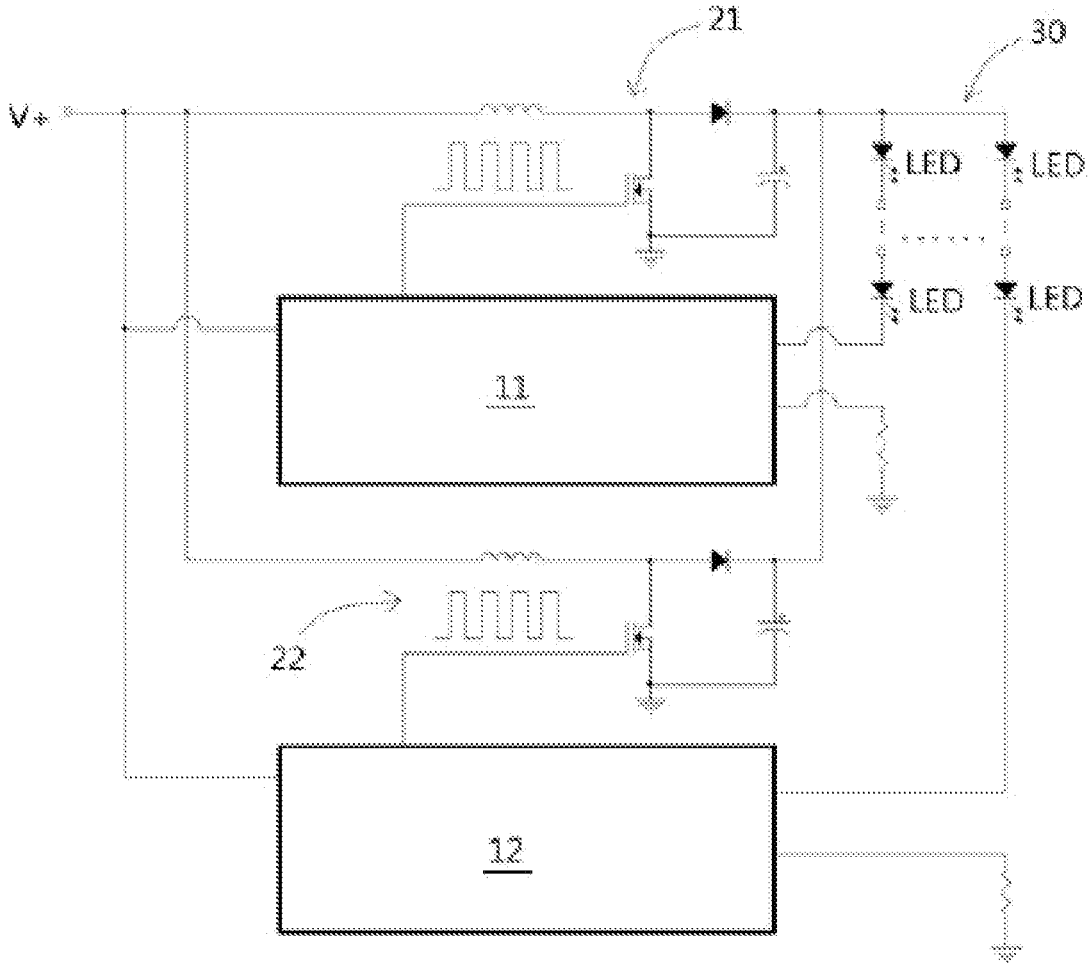
FIG. 1 PRIOR ART
FIG. 1 is a schematic diagram of a typical light emitting diode (LED) backlight driving circuit.
Figure 2:
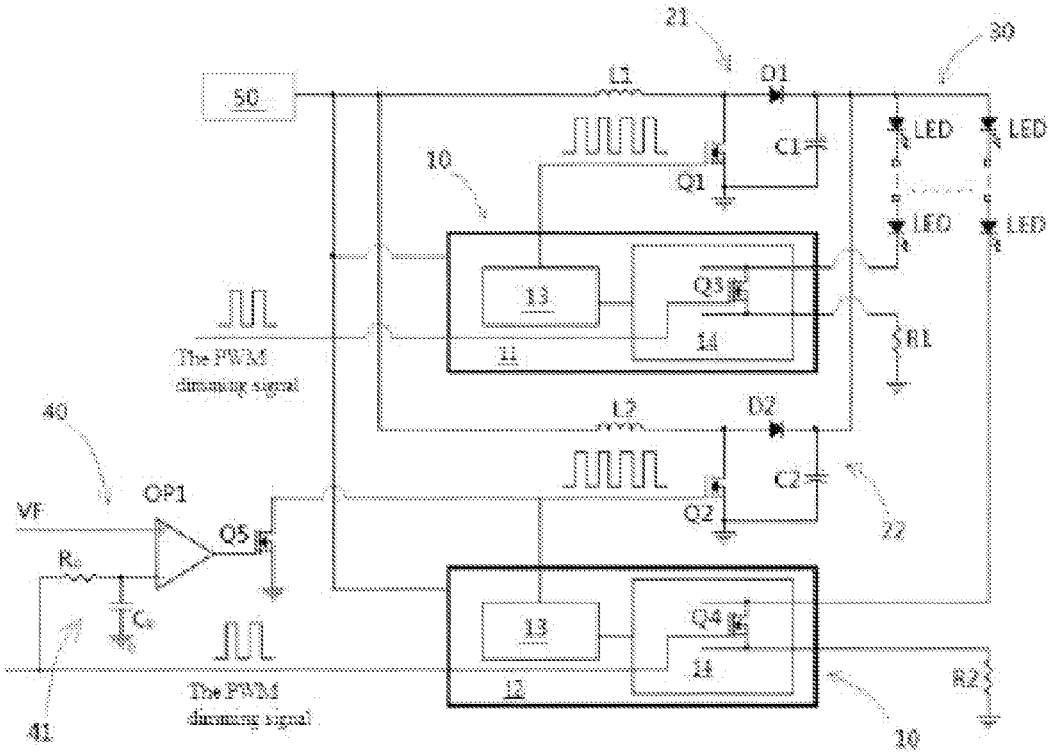
FIG. 2 is a schematic diagram of a light emitting diode (LED) backlight driving circuit of a first example of the present disclosure.

As shown in FIG. 2, the LED backlight driving circuit comprises a power supply 50, an LED light bar 30, and a constant current driving chip 10 that adjusts brightness of the LED light bar 30, where the constant current driving chip receives a PWM dimming signal. N boost units are connected in series between the power supply 50 and the LED light bar 30, and the N boost units are connected in parallel with each other. Comparing units are correspondingly coupled to control ends of one or more of (N−1) boost units. In the first example, the LED backlight driving circuit comprises a first boost unit 21 and a second boost unit 22, and the comparing unit 40 is coupled to a control end of the second boost unit 22.

The comparing unit 40 comprises a comparator OP1, a non-inverting end of the comparator OP1 receives a reference voltage VF, a converting unit 41 is coupled to an inverting end of the comparator OP1, and the converting unit 41 converts the PWM dimming signal to an equivalent voltage. A changing-over controllable switch Q5 is connected in series between the control end of the boost unit and a ground terminal of the LED backlight driving circuit. The converting unit 41 comprises a filter resistor R0 and a filter capacitor C0, the inverting end of the comparator OP1 receives the PWM dimming signal through the filter resistor R0, and the filter capacitor C0 is connected in series between the inverting end of the comparator OP1 and the ground terminal of the LED backlight driving circuit.

The reference voltage VF is less than or equal to the equivalent voltage of the PWM dimming signal corresponding to a 50% duty ratio. When the equivalent voltage outputted by the converting unit 41 is less than the reference voltage VF, the comparator OP1 drives the changing-over controllable switch Q5 to turn off.

If there are more than two boost units in the LED backlight driving circuit, a method that turns off the boost unit one by one may be used. Namely, when a maximum output power of the (N−1) boost units satisfies brightness requirement of the LED light bar, one boost unit turns off. When a maximum output power of the (N−2) boost units satisfies brightness requirement of the LED light bar, two boost units turn off, and so on. According to the above-mentioned method, least boost units drive the LED light bar, which improves the transfer efficiency and reduces energy loss. It should be understood, when the duty ratio of the PWM dimming signal is less than or equal to (100/N) %, only one boost unit turns on, and the remaining boost units turn off. When only one boost unit is in operation, the power loss is the least. Because the only one boost unit loads fully, the output power of the one boost unit is great, thereby further improving the transfer efficiency and reducing the energy loss.

Each of the boost units comprises an inductor (L1, L2), a diode (D1/D2), a voltage-adjusting controllable switch (Q1, Q2) that adjusts voltage, and a capacitor (C1, C2). The power supply 50 is coupled to an end of the inductor (L1, L2), and opposite end of the inductor (L1, L2) is coupled to an anode of the diode (D1, D2), and the opposite end of the inductor (L1, L2) is also coupled to the ground terminal of the LED backlight driving circuit through the voltage-adjusting controllable switch (Q1, Q2). A cathode of the diode (D1, D2) is coupled to an anode of the LED light bar, and the cathode of the diode (D1, D2) is also coupled to the ground terminal through the capacitor (C1, C2).

The constant current driving chip 10 comprises a control unit 13 and an adjusting unit 14 that adjusts the brightness of the LED light bar 30. A control end of the voltage-adjusting controllable switch (Q1, Q2) is coupled to the control unit 13. The adjusting unit 14 comprises a dimming controllable switch (Q3, Q4) that adjust dimming, an input end of the dimming controllable switch (Q3, Q4) is coupled to a cathode of the LED light bar 30, an output end of the dimming controllable switch (Q3, Q4) is coupled to the ground terminal of the LED backlight driving circuit through a divider resistor (R1, R2), and a control end of dimming controllable switch (Q3, Q4) receives the PWM dimming signal.

Each of the boost units corresponds to one constant current driving chip. Namely, the LED backlight driving circuit of the first example has two constant current driving chips, where the first constant current driving chip 11 controls the first boost unit 21, and the second constant current driving chip 12 controls the second boost unit 22. The LED light bar 30 is divided into two groups of LED light bars, and each of the constant current driving chips 10 controls one group of LED light bars 30.

Each of the constant current driving chips 10 corresponds to each of the boost units, and different boost units and the control circuits thereof are independent from each other. Loss of each of the boost units and the constant current driving chip thereof does not influence other boost units and the constant current driving chips thereof. A pluality of boost units drive a plurality of LED light bars 30, and a typical constant current driving chip 10 usually has no plurality of pins correspondingly connected with the LED light bars 30, thus the plurality of the constant current driving chips control the LED light bars without need to redesign the typical constant driving chip, thereby reducing development costs and development time.

In the first example, the converting unit 41 converts the PWM dimming signal having the rectangular wave into a stable direct voltage signal, and different duty ratios corresponding to different direct voltage signals. Thus, the equivalent voltage of the PWM dimming signal corresponding to the preset threshold is regarded as a comparison reference, which is compared with an output voltage signal of the converting unit 41, and a result of the comparison can be used to determine whether the duty ratio of the PWM dimming signal exceeds the preset threshold or not. The converting unit 41 transfers a comparison of the duty ratio to a simple comparison of the voltage, which reduces a difficult degree of technology, development time, and development costs. The present disclosure uses a resistance-capacity (RC) filter to convert a fluctuating PWM dimming signal having a high frequency into a stable voltage signal, which reduces costs.

Example 2

Figure 3:
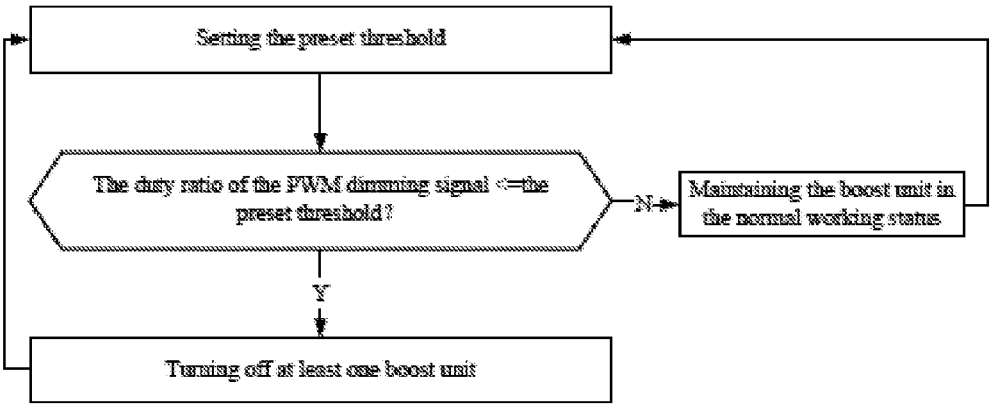
FIG. 3 is a schematic diagram of a light emitting diode (LED) backlight driving circuit of a second example of the present disclosure.

The present disclosure provides a method for driving the LED backlight driving circuit. The LED backlight driving circuit comprises the power supply 50, the LED light bar 30, and the constant current driving chip 10 that adjusts brightness of the LED light bar 30, where the constant current driving chip 10 receives the PWM dimming signal. N boost units are connected in series between the power supply and the LED light bar, and the N boost units are connected in parallel with each other. As shown in FIG. 3, the method comprises:

A: setting the preset threshold of the duty ratio of the PWM dimming signal;

B: detecting the duty ratio of the PWM dimming signal; when the duty ratio is less than the preset threshold, entering step C; when the duty ratio is greater than the preset threshold, entering step D;

C: controlling at least one boost unit to turn off, returning to the step A; and D: maintaining the boost unit in a normal operation, returning to the step A.

N is an integer greater than or equal to 2.

To improve transfer efficiency and reduce energy loss, a maximum output power of the boost unit satisfies brightness requirement of the LED light bar, thus, least boost units drive the LED light bar. Thus, in the step A, maximum output power $W_0$ of each of the boost units are preserved. In the step B, a number of the preset thresholds is (N−1), and each of the preset thresholds is the duty ratio of the PWM dimming signal coresponding to integer times of the output power $W_0$.

In the step C, determining total requirement power W of the LED light bar; if W is less than or equal to $(N-x)\ W_0$, turning off x boost units, then returning to the step A.

The present disclosure is described in detail in accordance with the above contents with the specific exemplary examples. However, this present disclosure is not limited to the specific examples. For the ordinary techical personnel of the technical field of the present disclosure, on the premise of keeping the conception of the present disclosure, the technical personnel can also make simple deductions or replacements, and all of which should be considered to belong to the protection scope of the present disclosure.

We claim:

1. A light emitting diode (LED) backlight driving circuit, comprising:

a power supply;

an LED light bar; and a constant current driving chip that adjusts brightness of the LED light bar;

wherein the constant current driving chip receives a pulse-width modulation (PWM) dimming signal; N boost units are connected in series between the power supply and the LED light bar, and the N boost units are connected in parallel with each other; comparing units are correspondingly coupled to control ends of one or more of (N−1) boost units;

when a duty ratio of the PWM dimming signal is less than a preset threshold, the comparing unit drives a corresponding boost unit to turn off; N is an integer greater than or equal to 2, wherein the comparing unit comprises a comparator, a non-inverting end of the comparator receives a reference voltage, a converting unit is coupled to an inverting end of the comparator, and the converting unit converts the PWM dimming signal to an equivalent voltage; a changing-over controllable switch is connected in series between the control end of the boost unit and a ground terminal of the LED backlight driving circuit;

the reference voltage is less than or equal to the equivalent voltage of the PWM dimming signal corresponding to the preset threshold; when the equivalent voltage outputted by the converting unit is less than the reference voltage, the comparator drives the changing-over controllable switch to turn off, wherein the converting unit comprises a filter resistor and a filter capacitor, the inverting end of the comparator receives the PWM dimming signal through the filter resistor, and the filter capacitor is connected in series between the inverting end of the comparator and the ground terminal of the LED backlight driving circuit.

2. The LED backlight driving circuit of claim 1, wherein each of the boost units comprises an inductor, a diode, a voltage-adjusting controllable switch that adjusts voltage, and a capacitor; the power supply is coupled to an end of the inductor, an opposite end of the inductor is coupled to an anode of the diode, and the opposite end of the inductor is coupled to a ground terminal of the LED backlight driving circuit through the voltage-adjusting controllable switch;

a cathode of the diode is coupled to an anode of the LED light bar, and the cathode of the diode is coupled to the ground terminal through the capacitor; a control end of the voltage-adjusting controllable switch is coupled to the constant current driving chip.

3. The LED backlight driving circuit of claim 1, wherein each of the boost units comprises an inductor, a diode, a voltage-adjusting controllable switch that adjusts voltage, and a capacitor; the power supply is coupled to an end of the inductor, an opposite end of the inductor is coupled to an anode of the diode, and the opposite end of the inductor is coupled to the ground terminal of the LED backlight driving circuit through the voltage-adjusting controllable switch;

a cathode of the diode is coupled to an anode of the LED light bar, and the cathode of the diode is coupled to the ground terminal through the capacitor; a control end of the voltage-adjusting controllable switch is coupled to the constant current driving chip.

4. The LED backlight driving circuit of claim 1, wherein (N−1) comparing units are correspondingly coupled to control ends of N−1 of N boost units; when the duty ratio of the PWM dimming signal is less than or equal to (100/N) %, the comparison unit drives the corresponding boost unit to turn off.

5. The LED backlight driving circuit of claim 4, wherein each of the boost units comprises an inductor, a diode, a voltage-adjusting controllable switch that adjusts voltage, and a capacitor; the power supply is coupled to an end of the inductor, an opposite end of the inductor is coupled to an anode of the diode, and the opposite end of the inductor is coupled to a ground terminal of the LED backlight driving circuit through the voltage-adjusting controllable switch;

a cathode of the diode is coupled to an anode of the LED light bar, and the cathode of the diode is coupled to the ground terminal through the capacitor; a control end of the voltage-adjusting controllable switch is coupled to the constant current driving chip.

6. A light emitting diode (LED) backlight driving circuit, comprising:

a power supply;

an LED light bar; and a constant current driving chip that adjusts brightness of the LED light bar;

wherein the constant current driving chin receives a pulse-width modulation (PWM) dimming signal; N boost units are connected in series between the power supply and the LED light bar, and the N boost units are connected in parallel with each other; comparing units are correspondingly coupled to control ends of one or more of (N−1) boost units:

when a duty ratio of the PWM dimming signal is less than a preset threshold, the comparing unit drives a corresponding boost unit to turn off; N is an integer greater than or equal to 2, wherein the constant current driving chip comprises a control unit that controls the boost unit to output a voltage, and an adjusting unit that adjusts brightness of the LED light bar; the adjusting unit comprises a dimming controllable switch that adjusts dimming, an input end of the dimming controllable switch is coupled to a cathode of the LED light bar, an output end of the dimming controllable switch is coupled to a ground terminal of the LED backlight driving circuit through a divider resistor, and a control end of dimming controllable switch receives the PWM dimming signal; each of the boost units corresponds to one constant current driving chip, and the LED light bars are divided into N groups of LED light bars, each of the boost units controls one group of LED light bars.

7. A light emitting diode (LED) backlight driving circuit, comprising:

a power supply;

an LED light bar; and a constant current driving chip that adjusts brightness of the LED light bar;

wherein the constant current driving chip receives a pulse-width modulation (PWM) dimming signal; N boost units are connected in series between the power supply and the LED light bar, and the N boost units are connected in parallel with each other; comparing units are correspondingly coupled to control ends of one or more of (N−1) boost units;

when a duty ratio of the PWM dimming signal is less than a preset threshold, the comparing unit drives a corresponding boost unit to turn off; N is an integer greater than or equal to 2, wherein a number of the boost unit is two, the control end of one of the two boost units is coupled to the comparison unit;

the comparing unit comprises a comparator, a non-inverting end of the comparator receives a reference voltage, a converting unit is coupled to an inverting end of the comparator, and the converting unit converts the PWM dimming signal to an equivalent voltage; a changing-over controllable switch is connected in series between the control end of the boost unit and a ground terminal of the LED backlight driving circuit;

the converting unit comprises a filter resistor and a filter capacitor, the inverting end of the comparator through the filter resistor receives the PWM dimming signal, and the filter capacitor is connected in series between the inverting end of the comparator and the ground terminal of the LED backlight driving circuit;

the reference voltage is less than or equal to the equivalent voltage of the PWM dimming signal corresponding to 50% duty ratio, when the equivalent voltage outputted by the converting unit is less than the reference voltage, the comparator drives the changing-over controllable switch to turn off;

each of the boosts unit comprises an inductor, a diode, a voltage-adjusting controllable switch that adjusts voltage, and a capacitor; the power supply is coupled to an end of the inductor, an opposite end of the inductor is coupled to an anode of the diode, and the opposite end of the inductor is coupled to the ground terminal of the LED backlight driving circuit through the voltage-adjusting controllable switch; a cathode of the diode is coupled to an anode of the LED light bar, and the cathode of the diode is coupled to the ground terminal through the capacitor;

the constant current driving chip comprises a control unit and an adjusting unit that adjusts brightness of the LED light bar; a control end of the voltage-adjusting controllable switch is coupled to the control unit; the adjusting unit comprises a dimming controllable switch that adjusts dimming, an input end of the dimming controllable switch is coupled to a cathode of the LED light bar, an output end of the dimming controllable switch is coupled to the ground terminal of the LED backlight driving circuit through a divider resistor, and a control end of dimming controllable switch receives the PWM dimming signal;

each of the boost units corresponds to one constant current driving chip, and the LED light bars are divided into two groups of LED light bars, each of the boost units controls one group of LED light bars.

* * * * *